US005456237A

United States Patent [19]

Yamazaki et al.

[11] Patent Number: 5,456,237

[45] Date of Patent: Oct. 10, 1995

[54] EVAPORATIVE FUEL PROCESSING DEVICE

[75] Inventors: Kazumi Yamazaki; Koichi Hidano; Teruo Wakashiro; Takeshi Hara, all of Wako; Tomoyuki Kawakami, Haga, all of Japan

[73] Assignee: Honda Giken Kogyo Kabushiki Kaisha, Tokyo, Japan

[21] Appl. No.: 317,804

[22] Filed: Oct. 4, 1994

[30] Foreign Application Priority Data

Oct. 4, 1993 [JP] Japan ..... 5-248245

[51] Int. Cl.[6] ..... F02M 33/02

[52] U.S. Cl. ..... 123/520; 123/519

[58] Field of Search ..... 123/520, 521, 123/518, 519, 516, 198 D; 55/387

[56] References Cited

U.S. PATENT DOCUMENTS

| | | | |
|---|---|---|---|
| 4,790,283 | 12/1988 | Uranishi | 123/520 |
| 4,815,436 | 3/1989 | Sasaki | 123/520 |
| 4,887,578 | 12/1989 | Woodcock | 123/519 |
| 4,951,643 | 8/1990 | Sato | 123/520 |
| 5,056,494 | 10/1991 | Kayanuma | 123/516 |
| 5,337,721 | 8/1994 | Kasuya | 123/519 |
| 5,393,329 | 2/1995 | Inagaki | 123/519 R |

FOREIGN PATENT DOCUMENTS

| | | | |
|---|---|---|---|
| 4121451 | 4/1992 | Japan | 123/519 |
| 4153556 | 5/1992 | Japan | 123/519 |
| 5195884 | 8/1993 | Japan | 123/519 |
| 5280435 | 10/1993 | Japan | 123/519 |

*Primary Examiner*—Carl S. Miller

*Attorney, Agent, or Firm*—Nikaido, Marmelstein, Murray & Oram

[57] ABSTRACT

In an evaporative fuel processing device, a canister is divided into first, second, third and fourth chambers by partition walls. A control valve is provided in a communication passage which connects the second and third chambers to each other. A first charge passage is connected to an upper space in a fuel tank and to a port in the third chamber, and a second charge passage is connected to a fuel supply valve for the fuel tank and to a port in the first chamber. Further, a purge passage is connected to an intake passage of an internal combustion engine and to a port in the first chamber. The control valve is connected to an electronic control unit, and opened during refueling and during traveling of a vehicle and closed during parking of the vehicle. Thus, it is possible to reliably prevent an evaporative fuel from being released to the atmosphere, while the capacity of the canister to a minimum.

5 Claims, 7 Drawing Sheets

EVAPORATIVE FUEL PROCESSING DEVICE

BACKGROUND OF THE INVENTION

1. Field of the Invention

The present invention relates to an evaporative fuel processing device including a canister for adsorbing an evaporative fuel generated in a fuel tank of a vehicle.

2. Description of the Prior Art

FIG. 5 illustrates a prior art evaporative fuel processing device, in which a first charge passage 01, a second charge passage 02 and a purge passage 03 are connected to one of end faces of a canister in which an adsorbent is accommodated. An atmosphere-opened passage 04 is defined in the other end face. The first charge passage 01 is connected to an upper space in a fuel tank T through a two-way valve 05, and the second charge passage 02 is connected to a breather tube of the fuel tank T through a fuel supply valve 06. Further, the purge passage 03 is connected to an intake passage of an internal combustion engine through a purge valve 07 which is controlled for opening and closing by an electronic control unit U.

With such a prior art evaporative fuel processing device, an evaporative fuel generated during parking or traveling of a vehicle is charged to the canister C through the first charge passage 01, and an evaporative fuel generated during refueling into the vehicle is charged to the canister C through the second charge passage 02. The evaporative fuel charged to the canister C is purged into the intake passage 08 through the purge passage 03.

FIG. 6 illustrates another prior art evaporative fuel processing device, in which a first canister Ca is interposed between a first charge passage 01 and a first purge passage 03*a*, and a second canister Cb is interposed between a second charge passage 02 and a second purge passage 03*b*. Purge valves 07*a* and 07*b* are provided in the first and second purge passage 03*a* and 03*b*, respectively and are controlled for opening and closing by an electronic control unit U.

With this evaporative fuel processing device, an evaporative fuel generated during parking and traveling of a vehicle is charged to the first canister Ca through the first charge passage 01, and an evaporative fuel generated during refueling into a vehicle is charged to the second canister Cb through the second charge passage 02. The evaporative fuels charged to the first and second canisters Ca and Cb are purged into the intake passage 08 through the first and second purge passages 03*a* and 03*b*.

In the evaporative fuel processing device shown in FIG. 5, the evaporative fuel generated in the fuel tank T during refueling is supplied to the canister C through the second charge passage 02 to charge the canister C at a high concentration (see FIG. 7A). Thereafter, when the vehicle travels, the purge passage 03 is evacuated into a negative pressure, causing air to be introduced through the atmosphere-opened passage 04 into the canister C, thereby purging the canister C. In this case, when the time of traveling of the vehicle is long, the purging of the canister is completely performed, but when the time of traveling of the vehicle is short, only a left half of the canister C near the atmosphere-opened passage 04 is purged and hence, the concentration of fuel adsorbed in the left half is reduced into a lower level, but the concentration of fuel adsorbed in the right half is maintained at a higher level (see FIG. 7B).

When the vehicle is parked to discontinue the purging, the adsorbed fuel of the higher concentration in the right half of the canister C is diffused into the left half, so that the concentration of the adsorbed fuel in the entire canister C is brought into a medium level (see FIG. 7C). Thereafter, when the evaporative fuel is supplied through the first charge passage 01 to the canister C due to an increase in temperature in the fuel tank T, there is caused a problem that the evaporative fuel supplied cannot completely be adsorbed to the canister C which has already been charged at the medium concentration, and such evaporative fuel may be released through the atmosphere-opened passage 04 to the atmosphere. (see FIG. 7D).

In the evaporative fuel processing device shown in FIG. 6, the two first and second canisters Ca and Cb are required, resulting not only in a complicated structure, but also in a problem that the first canister Ca does not at all contribute to the adsorption of the evaporative fuel generated in a large amount during refueling. Therefore, it is necessary to insure a large capacity for the second canister Cb and thus, the entire canister must be enlarged.

SUMMARY OF THE INVENTION

Accordingly, it is an object of the present invention to reliably prevent the evaporative fuel from being released to the atmosphere, without an unneeded increase in capacity of the canister.

To achieve the above object, according to a first aspect and feature of the present invention, there is provided an evaporative fuel processing device comprising a canister, a charge passage connected to a fuel tank and to the canister, and a purge passage connected to an intake passage of an internal combustion engine and to the canister, in which an evaporative fuel generated in the fuel tank is supplied to the canister through the charge passage and adsorbed to an adsorbent accommodated in the canister, and an evaporative fuel released from the adsorbent is supplied into the intake passage of the internal combustion engine through the purge passage, wherein the device further comprises a first and a second adsorbent accommodating space defined in the canister, a communication passage for connecting the first and second adsorbent accommodating spaces to each other, a control valve provided in the communication passage, and a control means for causing the first and second adsorbent accommodating spaces to be connected to each other by the control valve during refueling into the fuel tank.

With the first feature, it is possible to insure a sufficient adsorbent capacity by using both the adsorbent accommodating spaces during refueling when a large amount of evaporative fuel is generated, and to prevent the evaporative fuel from being released to the atmosphere.

In addition to the first feature, according to a second aspect and feature of the present invention, the charge passage comprises a first charge passage through which the evaporative fuel generated during a time other than refueling is guided to the second adsorbent accommodating space, and a second charge passage through which the evaporative fuel generated during refueling is guided to the first adsorbent accommodating space.

With the second feature, it is possible to increase the adsorption efficiency of the adsorbent accommodated in each of the adsorbent accommodating spaces.

In addition to the first feature, according to a third aspect and feature of the present invention, the control means causes the first and second adsorbent accommodating spaces to be put into communication with each other by the control valve during releasing of the evaporative fuel from the canister.

With the third feature, in releasing the evaporative fuel from the canister, the first and second adsorbent accommodating spaces are put into communication with each other by the control valve and therefore, it is possible to release the adsorbed fuels in both the adsorbent accommodating spaces together.

In addition to the first feature, according to a fourth aspect and feature of the present invention, the control means causes the first and second adsorbent accommodating spaces to be put out of communication with each other by the control valve during parking of the vehicle.

With the fourth feature, it is possible to prevent the evaporative fuel from being diffused from the first adsorbent accommodating space having a higher concentration of evaporative fuel adsorbed into the second adsorbent accommodating space having a lower concentration of evaporative fuel adsorbed, and to prevent the evaporative fuel from being released from the second adsorbent accommodating space to the atmosphere during traveling of the vehicle.

In addition to the first feature, according to a fourth aspect and feature of the present invention, the adsorbent accommodated in the first adsorbent accommodating space has a characteristic that is liable to adsorb high boiling point components of the fuel, and the adsorbent accommodated in the second adsorbent accommodating space has a characteristic that is liable to adsorb lowly-boiling components of the fuel.

With the fifth feature, it is possible to effectively adsorb any of the highly- and lowly-boiling components of the fuel.

The above and other objects, features and advantages of the invention will become apparent from the following description of preferred embodiments taken in conjunction with the accompanying drawings.

DESCRIPTION OF THE PREFERRED EMBODIMENTS

The present invention will now be described by way of preferred embodiments in connection with the accompanying drawings.

Figure 1:
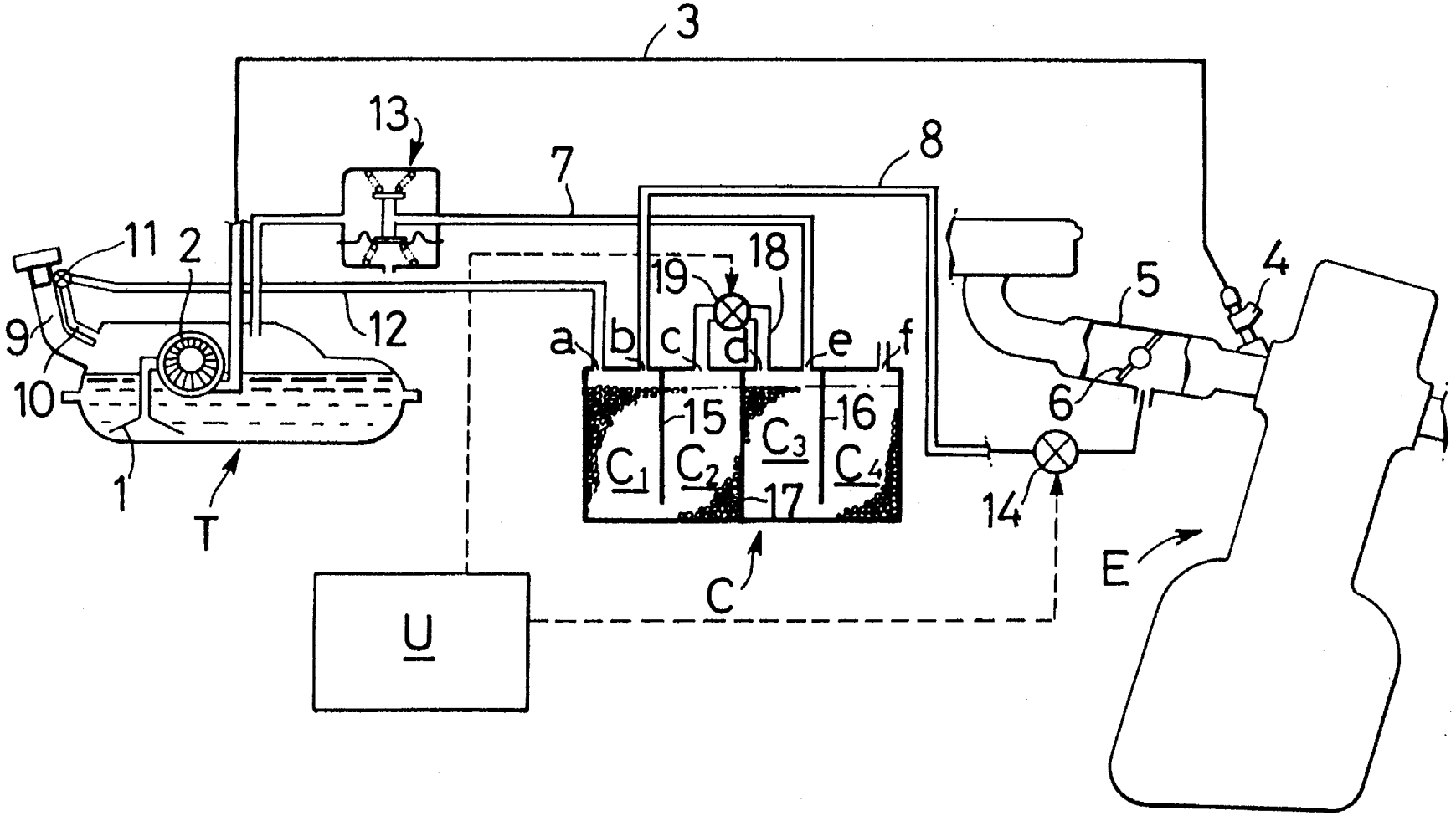
FIG. 1 is an illustration of the entire arrangement of an evaporative fuel processing device according to a first embodiment of the present invention.

As shown in FIG. 1 illustrating a first embodiment, a fuel pumped from a fuel tank T through a filter 1 and a fuel pump 2 is supplied through a feed passage 3 to a fuel injection valve 4 of an internal combustion engine E. An upper space in the fuel tank T is connected with a downstream portion of a throttle valve 6 provided in an intake passage 5 in the internal combustion engine E by a first charge passage 7 and a purge passage 8 between which a canister C is interposed. An upper end of a filler tube 9 for supplying an oil to the fuel tank T is connected with the internal space in the fuel tank T through a breather tube 10. The breather tube 10 is connected at its upper end to the canister C through a fuel supply valve 11 opened for supplying the oil and a second charge passage 12. A two-way valve 13 is provided in the first charge passage 7, and a purge valve 14 comprising a solenoid valve is provided in the purge passage 8.

The two-way valve 13 is opened when the internal pressure in the fuel tank T is increased to exceed the atmospheric pressure by a predetermined value and also when the internal pressure in the fuel tank T is reduced to below the internal pressure in the canister C by another predetermined value, thereby put the fuel tank T and the canister C into communication with each other. When the purge valve 14 is opened, the canister C and the intake passage 5 are put into communication with each other, and when the purge valve 14 is closed, the communication between the canister C and the intake passage 5 is blocked.

The canister C includes a first to fourth chambers $C_1$ to $C_4$ each having an adsorbent comprised of activated carbon accommodated therein. The first and second chambers $C_1$ and $C_2$ are partitioned from each other by a partition wall 15 opened at its lower end, and the third and fourth chambers $C_3$ and $C_4$ are partitioned from each other by a partition wall 16 opened at its lower end. Further, the second and third chambers $C_2$ and $C_3$ are partitioned from each other by a partition wall 17 having no opening. The first and second chambers $C_1$ and $C_2$ define a first adsorbent accommodating space of the present invention, and the third and fourth chambers $C_3$ and $C_4$ define a second adsorbent accommodating space of the present invention.

An evaporative fuel generated from the fuel tank during refueling contains a large number of high boiling point components. An adsorbent suitable for adsorption of such high boiling point components is selected as the adsorbent in each of the first and second chambers $C_1$ and $C_2$ for mainly adsorbing such evaporative fuel. In addition, an evaporative fuel generated from the fuel tank during traveling or parking of a vehicle contains a large number of low boiling point components and therefore, an adsorbent suitable for adsorption of such low boiling point components is selected as the adsorbent in each of the third and fourth chambers $C_3$ and $C_4$. The amount of evaporative fuel generated during refueling is larger than the amount of evaporative fuel generated during traveling or parking of the vehicle and hence, the capacity of the adsorbent in each of the first and second chambers $C_1$ and $C_2$ is set at a value larger than those of the adsorbents in the third and fourth chambers $C_3$ and $C_4$.

Two ports a and b are provided in an upper portion of the first chamber $C_1$ in the canister C. The port a is connected to the second charge passage 12, and the port b is connected to the purge passage 8. A port c provided in an upper portion of the second chamber $C_2$ in the canister C and a port d provided in an upper portion of the third chamber $C_3$ are connected to each other by a communication passage 18. A control valve 19 comprised of a solenoid valve is provided in the communication passage 18 for opening and closing the latter. Further, a port e provided in an upper space of the third chamber $C_3$ is connected to the first charge passage 7, and a port f provided in an upper portion of the fourth chamber $C_4$ is opened to the atmosphere.

The control valve 19 provided in the communication passage 18 is connected to an electronic control unit U. The control valve 19 is opened during traveling of the vehicle and during refueling to the fuel tank T and closed during parking of the vehicle. The purge valve 14 provided in the purge passage 8 is connected to the electronic control unit U, and opened during traveling of the vehicle and closed during parking of the vehicle.

The operation of the first embodiment of the present invention having the above-described construction will be described below.

During refueling to the fuel tank T, the fuel supply valve 11 provided at the upper end of the breather tube 10 is opened, thereby permitting air containing the evaporative fuel in the fuel tank T to be supplied through the second charge passage 12 to the port a in the first chamber $C_1$ in the canister C. At this time, the control valve 19 is in its opened state, and the purge valve 14 is in its closed state. Therefore, the evaporative fuel supplied to the port a charges the first, second, third and fourth chambers $C_1$, $C_2$, $C_3$ and $C_4$ sequentially, and only the air from which the evaporative fuel has been removed is released through the port f of the fourth chamber $C_4$ to the atmosphere. In this way, all the first to fourth chambers $C_1$ to $C_4$ contribute to the adsorption of a large amount of evaporative fuel generated during refueling and therefore, it is possible to minimized the capacity of the entire canister C.

If the vehicle travels in a state in which the fuel supply valve 11 is closed upon completion of the refueling and the first to fourth chambers $C_1$ to $C_4$ in the canister C are charged, the purge valve is opened according to a command from the electronic control unit U. As a result, the port b in the first chamber $C_1$ is evacuated through the purge passage 8 by a negative pressure within the intake passage 5, so that air is introduced through the port f of the fourth chamber $C_4$, thereby permitting the fourth, third, second and first chambers $C_4$, $C_3$, $C_2$ and $C_1$ to be purged sequentially. If the time of traveling of the vehicle is long, then all the first to fourth chambers $C_1$ to $C_4$ are purged as shown in FIG. 2E. If the time of traveling of the vehicle is short, then the fourth and third chambers $C_4$ and $C_3$ closer to the port f are completely purged, but the second and first chambers $C_2$ and $C_1$ far from the port f are not completely purged, resulting in a state in which some of the adsorbed fuel remains therein.

When the vehicle is parked after traveling of the vehicle for only a short time, the control valve 19 is closed by a command from the electronic control unit U to block the communication between the second and third chambers $C_2$ and $C_3$, and the purge valve 14 is closed by a command from the electronic control unit U. In this manner, the first and second chambers $C_1$ and $C_2$ are put out of communication with the third and fourth chambers $C_3$ and $C_4$ by closing of the control valve 19 upon parking of the vehicle. Therefore, the adsorbed fuel remaining in the first and second chambers $C_1$ and $C_2$ is reliably prevented from being diffused into the third and fourth chambers $C_3$ and $C_4$.

Figure 2A:
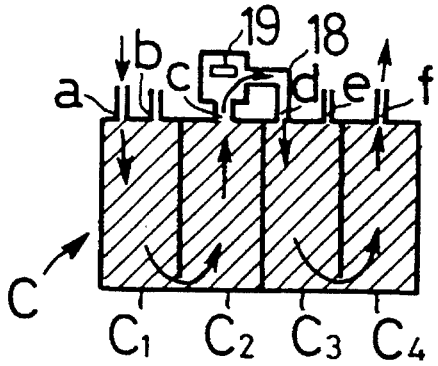
FIGS. 2A–2E are views for explaining the operation of the first embodiment.
Figure 2B:
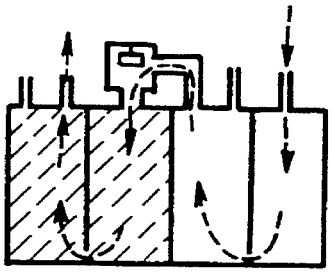
Figure 2C:
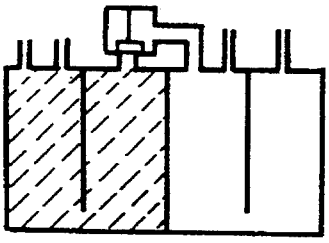
Figure 2D:
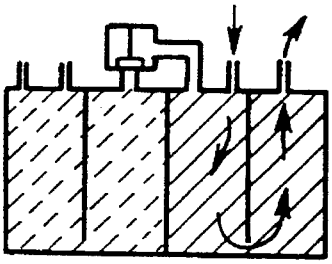
Figure 2E:
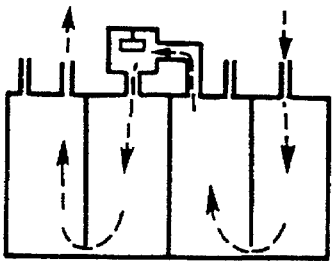

If the temperature in the fuel tank T is risen by the direct rays of the sun or the like during parking of the vehicle, the evaporative fuel generated in the fuel tank T is supplied through the first charge passage 7 to the port e of the third chamber $C_3$ to charge the third and fourth chambers $C_3$ and $C_4$ sequentially as shown in FIG. 2D. During this time, the third and fourth chambers $C_3$ and $C_4$ have been preferentially purged during traveling of the vehicle as described above, and moreover, the adsorbed fuel remaining in the first and second chambers $C_1$ and $C_2$ is prevented from being diffused into the third and fourth chambers $C_3$ and $C_4$ by closing of the control valve 19 during parking of the vehicle. Therefore, a sufficient adsorbing power for the evaporative fuel is left in the third and fourth chambers $C_3$ and $C_4$, thereby reliably avoiding a disadvantage that an amount of the evaporative fuel not completely adsorbed is released through the port f to the atmosphere.

A second embodiment of the present invention will now be described in connection with FIGS. 3 and 4.

Figure 3:
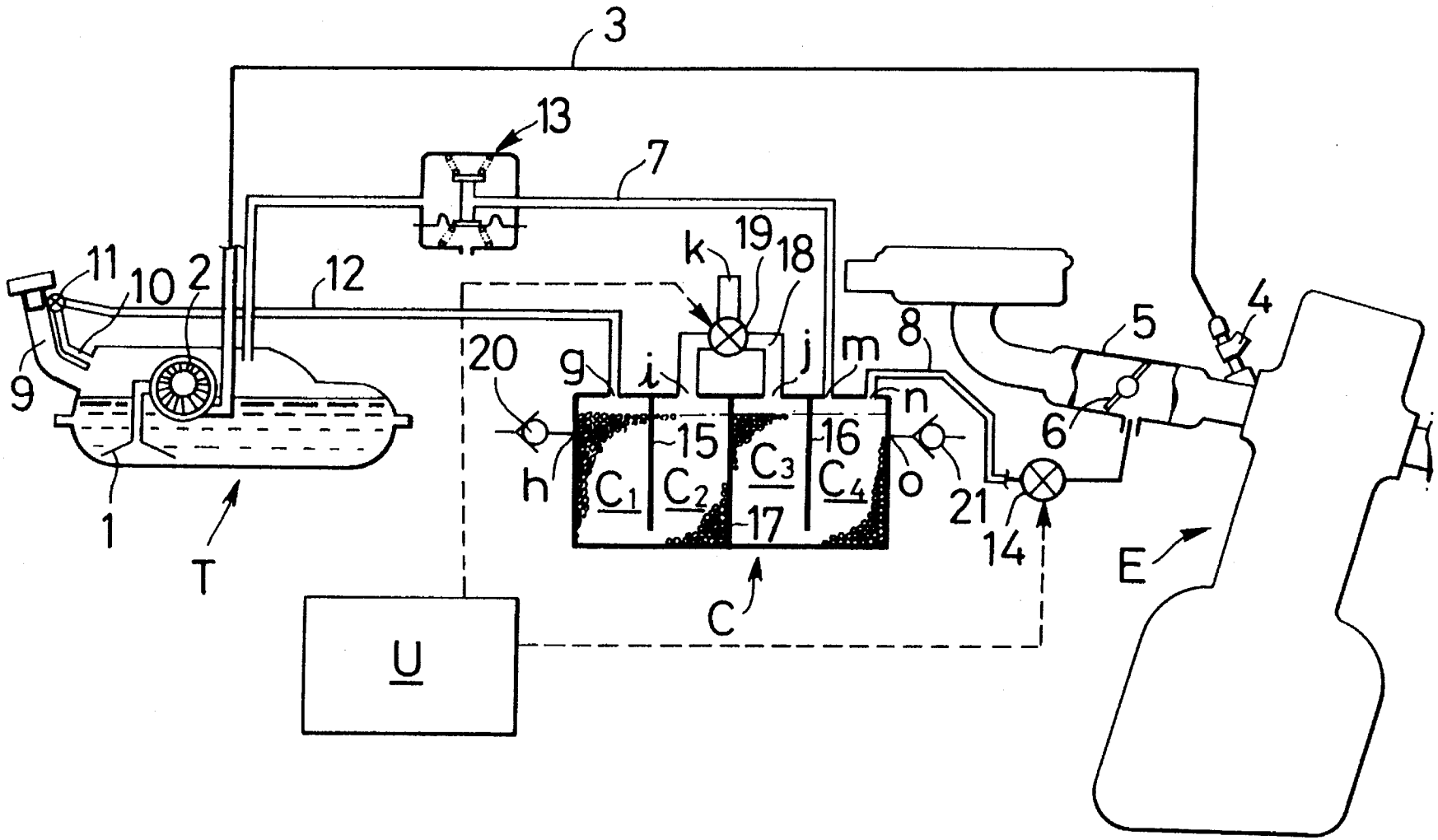
FIG. 3 is an illustration of the entire arrangement of an evaporative fuel processing device according to a second embodiment of the present invention.

As shown in FIG. 3, the second embodiment is different from the first embodiment in respect of the connection of each passage to the canister C, and is substantially the same as the first embodiment in respect of other constructions.

according to the second embodiment, two ports g and h are provided in the first chamber $C_1$ in the canister C. The port g is connected to the second charge passage 12, and a check valve 20 for permitting the communication from the atmosphere to the first chamber $C_1$ is connected to the port h. A port i provided at an upper portion of the second chamber $C_2$ in the canister C and a port j provided at an upper portion of the third chamber $C_3$ are connected to each other by a communication passage 18. A control valve 19 comprised of a solenoid valve is provided in the communication passage 18. The solenoid valve 19 permits the port j and a port k (an atmosphere-opened port), or the ports i and j to be selectively put into communication with each other. Further, three ports m, n and o are provided in the fourth chamber $C_4$. The port m is connected to the first charge passage 7; the port n is connected to the purge passage 8, and a check valve 21 is connected to the port o for permitting the fourth chamber $C_4$ into communication with the atmosphere.

The control valve 19 provided in the communication passage 18 is connected to an electronic control unit U. The control valve 19 permits the ports i and j to be put into communication with each other during traveling of the vehicle and during refueling to the fuel tank T and permits the ports j and k to be put into communication with each other during parking of the vehicle. The purge valve 14 provided in the purge passage 8 is opened during traveling of the vehicle and closed during parking of the vehicle, as in the first embodiment.

An adsorbent suitable for adsorbing high boiling point components of the evaporative fuel liable to be generated during traveling of the vehicle and during refueling is selected as the adsorbent in each of the first and second chambers $C_1$ and $C_2$, as in the first embodiment. In addition, an adsorbent suitable for adsorption of the low boiling point components of the evaporative fuel generated from the fuel tank during traveling or parking of a vehicle is selected as the adsorbent in each of the third and fourth chambers $C_3$ and $C_4$.The capacity of the adsorbent in each of the first and second chambers $C_1$ and $C_2$ is set at value larger than those in the first embodiment, so that most of the evaporative fuel generated during refueling is adsorbed to the adsorbents in the first and second chambers $C_1$ and $C_2$, and when there is an amount of the evaporative fuel not completely adsorbed to the adsorbents in the first and second chambers $C_1$ and $C_2$, such evaporative fuel is adsorbed to the adsorbents in the third and fourth chambers $C_3$ and $C_4$.

The operation of the second embodiment of the present invention having the above-described construction will be described below.

Figure 4A:
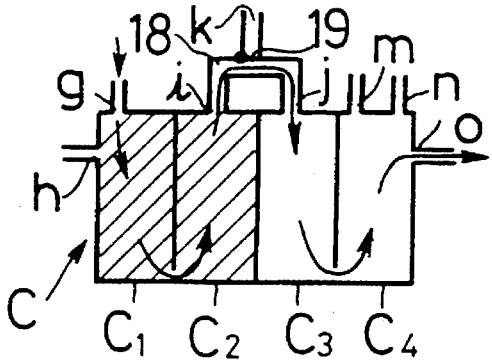
FIGS. 4A–4B are views for explaining the operation of the second embodiment.
Figure 4B:
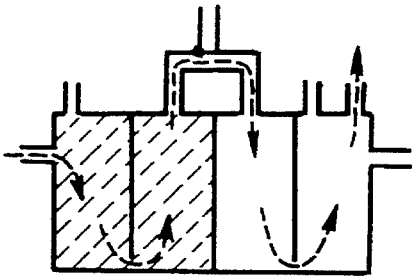
Figure 4C:
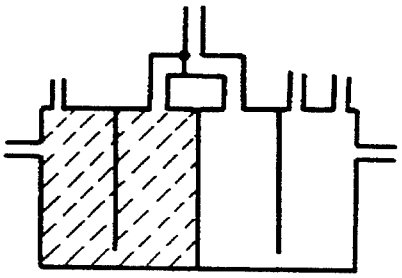

During refueling to the fuel tank T, the fuel supply valve 11 provided at the upper end of the breather tube 10 is opened, thereby permitting air containing the evaporative fuel in the fuel tank T to be supplied through the second charge passage 12 to the port g in the first chamber $C_1$ to charge the first and second chambers $C_1$ and $C_2$ sequentially, as shown in FIG. 4A. At this time, the third and fourth chambers $C_3$ and $C_4$ are not charged almost at all, because the capacity of the adsorbent in each of the first and second chambers $C_1$ and $C_2$ is set at a sufficiently large value.

If the vehicle travels after completion of the refueling, the purge valve 14 is opened by a command from the electronic control unit U. As a results, the port n of the fourth chamber $C_4$ is evacuated through the purge passage 8 by a negative pressure in the intake passage 5, so that the air is introduced through the port h of the first chamber $C_1$, thereby causing the first and second chambers $C_1$ and $C_2$ to be purged sequentially. When the time of traveling of the vehicle is long, the first and second chambers $C_1$ and $C_2$ are entirely purged. When the time of traveling of the vehicle is short, the first and second chambers $C_1$ and $C_2$ are not completely purged, resulting in a state in which some of the adsorbed fuel remains therein.

When the vehicle is parked after a short traveling, the control valve 19 is driven by a command from the electronic control unit U to block the communication between the second and third chambers $C_2$ and $C_3$, and the purge valve 14 is closed by a command from the electronic control unit U. In this manner, the first and second chambers $C_1$ and $C_2$ are put out of communication with the third and fourth chambers $C_3$ and $C_4$ by closing of the control valve 19 upon parking of the vehicle. Therefore, the adsorbed fuel remaining in the first and second chambers $C_1$ and $C_2$ is reliably prevented from being diffused into the third and fourth chambers $C_3$ and $C_4$.

Figure 4D:
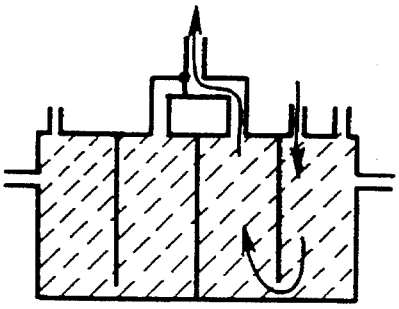
Figure 4E:
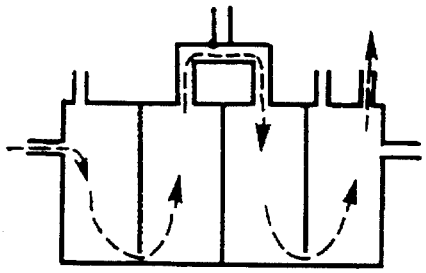
Figure 5:
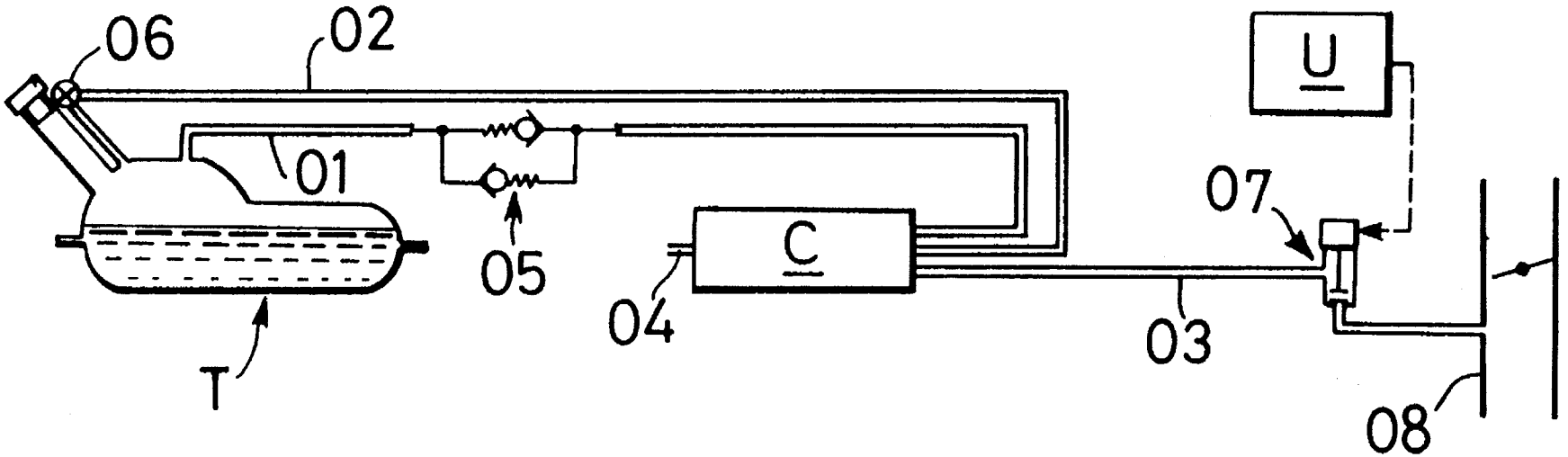
FIG. 5 is an illustration of the entire arrangement of a prior art evaporative fuel processing device.
Figure 6:
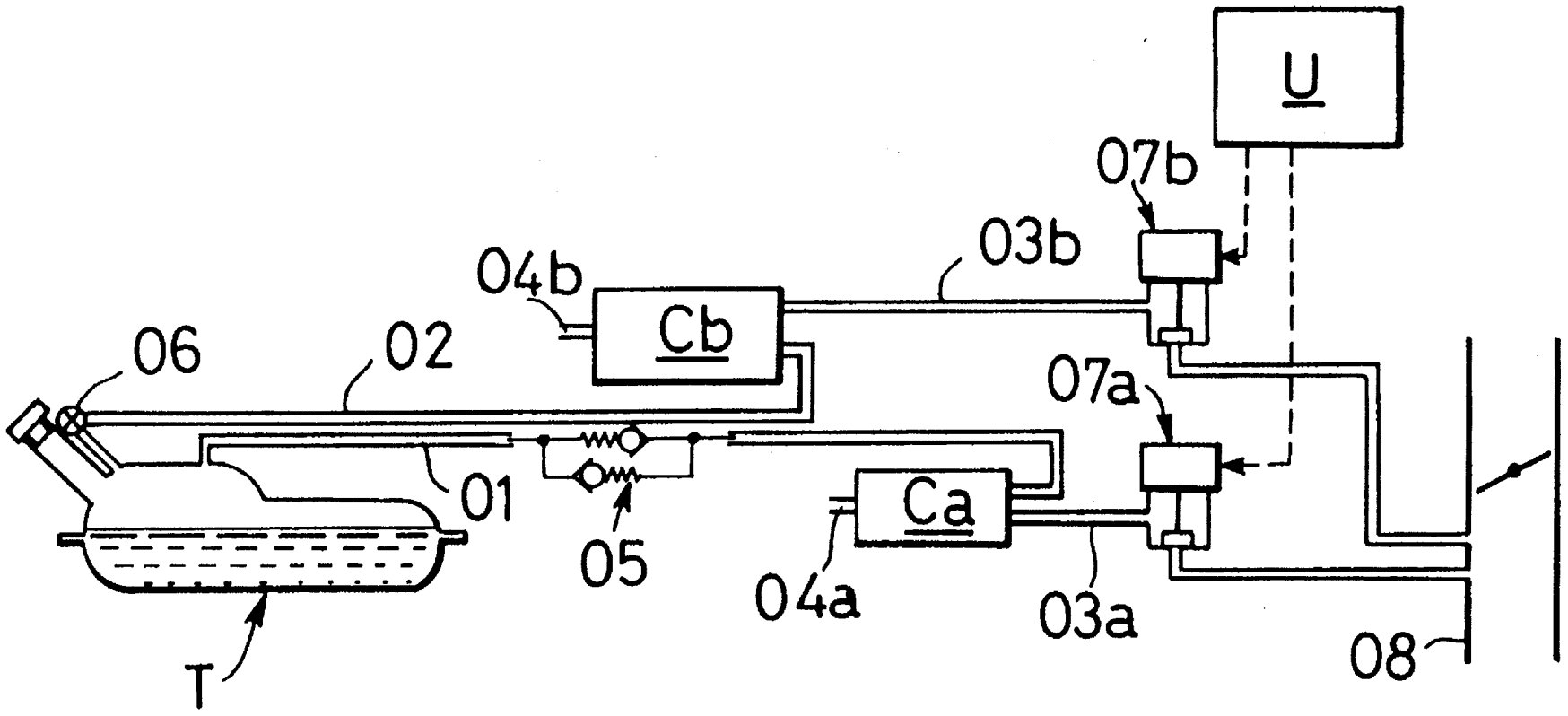
FIG. 6 is an illustration of the entire arrangement of another prior art evaporative fuel processing device.
Figure 7A:
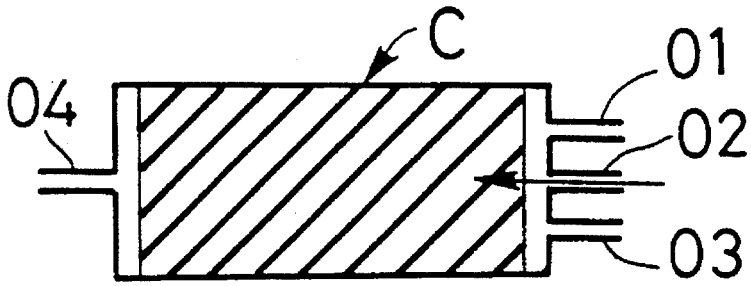
FIGS. 7A–7D are views for explaining the operation of the prior art device shown in FIG. 5.
Figure 7B:
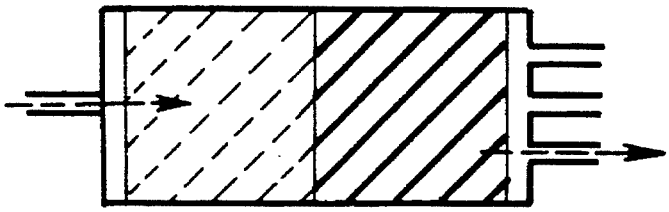
Figure 7C:
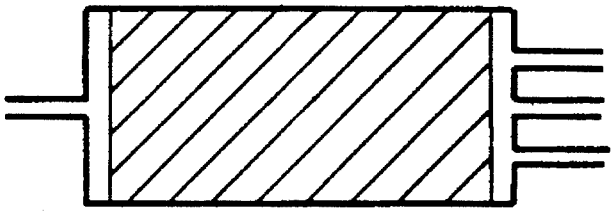
Figure 7D:
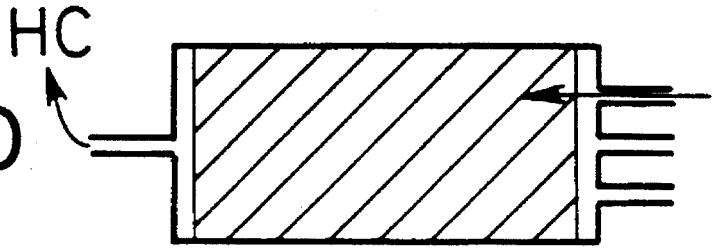

If the temperature in the fuel tank T is risen by the direct rays of the sun or the like during parking of the vehicle, the evaporative fuel generated in the fuel tank T is supplied through the first charge passage 7 to the port m of the fourth chamber $C_4$ to charge the third and fourth chambers $C_3$ and $C_4$ sequentially, as shown in FIG. 4D. During this time, the third and fourth chambers $C_3$ and $C_4$ are kept uncharged during refueling as described above, and moreover, the adsorbed fuel remaining in the first and second chambers $C_1$ and $C_2$ is prevented from being diffused into the third and fourth chambers $C_3$ and $C_4$ during parking of the vehicle. Therefore, a sufficient adsorbing power for the evaporative fuel is left in the third and fourth chambers $C_3$ and $C_4$, thereby reliably avoiding a disadvantage that a large amount of the evaporative fuel which could not be adsorbed is released through the port k to the atmosphere.

Although the embodiments of the present invention have been described in detail, it will be understood that the present invention is not limited to these embodiments and various modifications may be made without departing from the spirit and scope of the invention defined in claims.

What is claimed is:

1. An evaporative fuel processing device comprising a canister, a charge passage connected to a fuel tank and to the canister, and a purge passage connected to an intake passage of an internal combustion engine and to the canister, in which an evaporative fuel generated in the fuel tank is supplied to the canister through the charge passage and adsorbed to an adsorbent accommodated in the canister, and an evaporative fuel released from the adsorbent is supplied into the intake passage of the internal combustion engine through the purge passage, wherein said device further comprises:

a first and a second adsorbent accommodating space defined in said canister;

a communication passage for connecting said first and second adsorbent accommodating spaces to each other;

a control valve provided in said communication passage; and a control means for causing said first and second adsorbent accommodating spaces to be connected to each other by said control valve during refueling into said fuel tank.

2. An evaporative fuel processing device according to claim 1, wherein said charge passage comprises a first charge passage through which the evaporative fuel generated during a time other than refueling is guided to said second adsorbent accommodating space, and a second charge passage through which the evaporative fuel generated during refueling is guided to said first adsorbent accommodating space.

3. An evaporative fuel processing device according to claim 1, wherein said control means causes said first and second adsorbent accommodating spaces to be put into communication with each other by said control valve during releasing of the evaporative fuel from the canister.

4. An evaporative fuel processing device according to claim 1, wherein said control means causes said first and second adsorbent accommodating spaces to be put out of communication with each other by said control valve during parking of the vehicle.

5. An evaporative fuel processing device according to claim 1, wherein the adsorbent accommodated in the first adsorbent accommodating space has a characteristic that is liable to adsorb high boiling point components of the fuel, and the adsorbent accommodated in the second adsorbent accommodating space has a characteristic that is liable to adsorb lowly-boiling components of the fuel.

* * * * *